US007057610B2

(12) United States Patent
Kataoka et al.

(10) Patent No.: US 7,057,610 B2
(45) Date of Patent: Jun. 6, 2006

(54) DISPLAY UNIT, INFORMATION PROCESSING UNIT, DISPLAY METHOD, PROGRAM, AND RECORDING MEDIUM

(75) Inventors: Rieko Kataoka, Sagamihara (JP); Masaki Kobayashi, Tokyo-to (JP); Hideki Ogawa, Fujisawa (JP); Tetsuya Sakaedani, Sagamihara (JP)

(73) Assignee: International Business Machines Corporation, Armonk, NY (US)

( * ) Notice: Subject to any disclaimer, the term of this patent is extended or adjusted under 35 U.S.C. 154(b) by 209 days.

(21) Appl. No.: 10/248,149

(22) Filed: Dec. 20, 2002

(65) Prior Publication Data

US 2003/0122807 A1 Jul. 3, 2003

(30) Foreign Application Priority Data

Dec. 26, 2001 (JP) ..... 2001-395280

(51) Int. Cl.
*G09G 5/00* (2006.01)

(52) U.S. Cl. ..... 345/211; 345/88; 345/690

(58) Field of Classification Search ..... 345/87–105, 345/690, 210–213
See application file for complete search history.

(56) References Cited

U.S. PATENT DOCUMENTS

| | | | | |
|---|---|---|---|---|
| 5,828,367 | A * | 10/1998 | Kuga | 345/211 |
| 6,005,559 | A * | 12/1999 | Miyamoto | 345/212 |
| 6,046,737 | A * | 4/2000 | Nakamura | 345/213 |
| 6,339,422 | B1 * | 1/2002 | Kuwajima et al. | 345/204 |
| 6,417,829 | B1 * | 7/2002 | Jung et al. | 345/98 |
| 6,603,469 | B1 * | 8/2003 | Gettemy et al. | 345/211 |
| 2001/0044332 | A1 * | 11/2001 | Yamada et al. | 455/574 |
| 2001/0045944 | A1 * | 11/2001 | Iwasaki | 345/204 |
| 2002/0041281 | A1 * | 4/2002 | Yanagi et al. | 345/212 |
| 2003/0222866 | A1 * | 12/2003 | Funston et al. | 345/211 |

* cited by examiner

*Primary Examiner*—Xiao Wu
(74) *Attorney, Agent, or Firm*—Jeanine S. Ray-Yarletts; Daniel D. McConnell

(57) ABSTRACT

A display unit 200 equipped with a panel 230 in which pixels are arranged in a matrix, includes: a mode setting section 240 for setting the display unit 200 to one of a plurality of display modes; a voltage supply section 250 for changing a drive voltage which serves as a reference voltage for voltage supplied to the panel 230, according to the display mode set by the mode setting section 240; a gate driver 260 for supplying a selection signal to a plurality of the pixels arranged in a row direction in the panel 230; and a source driver 270 for supplying each of the plurality of pixels selected based on the selection signal with a pixel drive voltage generated according to luminance data which specifies luminance of the given pixel and to the drive voltage.

9 Claims, 9 Drawing Sheets

| Mode | Display mode | | | Cycle 1 | Cycle 2 | Cycle 3 | Cycle 4 |
|---|---|---|---|---|---|---|---|
| 1 | Normal mode | | | VA', VB' =Vhigh | VA', VB' =-Vhigh | VA', VB' =Vhigh | VA', VB' =-Vhigh |
| 2 | Low-power mode | Low drive voltage display | | VA', VB' =$Vlow_1$ | VA', VB' =-$Vlow_1$ | VA', VB' =$Vlow_1$ | VA', VB' =-$Vlow_1$ |
| 3 | | Alternate-row display | Even-numbered rows | VA', VB' =Vhigh | VA', VB' =-Vhigh | VA', VB' =$Vlow_2$ | VA', VB' =-$Vlow_2$ |
| | | | Odd-numbered rows | VA', VB' =$Vlow_2$ | VA', VB' =-$Vlow_2$ | VA', VB' =Vhigh | VA', VB' =-Vhigh |
| 4 | | Alternate-column display | | VA' =Vhigh<br>VB' =$Vlow_2$ | VA' =-Vhigh<br>VB' =-$Vlow_2$ | VA' =$Vlow_2$<br>VB' =Vhigh | VA' =-$Vlow_2$<br>VB' =-Vhigh |
| 5 | | Checker display | Even-numbered rows | VA' =Vhigh<br>VB' =$Vlow_2$ | VA' =-Vhigh<br>VB' =-$Vlow_2$ | VA' =$Vlow_2$<br>VB' =Vhigh | VA' =-$Vlow_2$<br>VB' =-Vhigh |
| | | | Odd-numbered rows | VA' =$Vlow_2$<br>VB' =Vhigh | VA' =-$Vlow_2$<br>VB=-Vhigh | VA' =Vhigh<br>VB' =$Vlow_2$ | VA' =-Vhigh<br>VB' =-$Vlow_2$ |
| 6 | | Changed-inversion-cycle display | | VA', VB' =Vhigh | VA', VB' =Vhigh | VA', VB' =-Vhigh | VA', VB' =-Vhigh |

*FIG. 6*

DISPLAY UNIT, INFORMATION PROCESSING UNIT, DISPLAY METHOD, PROGRAM, AND RECORDING MEDIUM

BACKGROUND OF THE INVENTION

The present invention relates to a display unit, information processing unit, display method, and recording medium. More particularly, it relates to display unit or information processing unit equipped with a panel in which pixels are arranged in a matrix as well as to a related display method, program, or recording medium.

Technologies for reducing power consumption of display units or extending the life of display units are disclosed, for example, in Japanese Published Unexamined Patent Applications No. 10-31464, No. 9-33888, and No. 5-323902, No. 10-124006.

Japanese Published Unexamined Patent Application No. 10-31464 discloses a technology for reducing voltage fluctuations in output signals of scan line drivers feeding voltage to row direction pixels and data drivers feeding voltage to column direction pixels in an in-plane switching (IPS) liquid crystal display by providing two values—low and high—of potential to be applies to common lines feeding to all pixels and by reversing them on a frame by frame basis.

Japanese Published Unexamined Patent Application No. 9-33888 discloses a liquid crystal display, which comprises a first drive mode for applying a selection voltage to each common electrode which feeds voltage to row direction pixels; a second drive mode for applying a selection voltage to each common electrode group organized along the column direction, wherein the second drive mode reduces power consumption.

Japanese Published Unexamined Patent Application No. 5-323902 discloses a liquid crystal display which comprises a circuit for converting data by controlling external signals based on a predetermined law, in a data line drive circuit for supplying voltage to row direction pixels, and achieves long life by creating a display using converted display data.

Japanese Published Unexamined Patent Application No. 10-124006 discloses a portable information terminal which automatically adjusts liquid crystal drive voltage in accordance with a bias ratio to achieve an optimum contrast ratio when the user adjusts the bias ratio of a liquid crystal display.

It is desirable that a display unit, which visually displays information for the user, should allow the user to make appropriate trade-offs between easy screen viewing and low power consumption even in low-power mode such as power saving mode or life extension mode.

BRIEF SUMMARY OF THE INVENTION

Thus, a purpose of the present invention is to provide a display unit, information processing unit, display method, program, and recording medium which can solve the above problem. This purpose is served by a combination of features set forth in the independent claims herein. The dependent claims further present advantageous concrete examples of the present invention.

Specifically, a first aspect of the present invention provides a display unit equipped with a panel in which pixels are arranged in a matrix, including: a mode setting section for setting a display mode of the above described display unit to one of a plurality of the above described display modes; a voltage supply section for changing a drive voltage which serves as a reference voltage for voltage supplied to the above described panel, according to the above described display mode set by the above described mode setting section; a gate driver for supplying a selection signal to a plurality of the above described pixels arranged in the row direction on the above described panel; and a source driver for supplying each of the above described plurality of pixels selected based on the above described selection signal with a pixel drive voltage generated according to luminance data which specifies luminance of the given pixel and to the above described drive voltage.

The above described display unit may be a normally black display unit in which the luminance of the above described pixel decreases with decreases in a potential difference applied to the above described pixel by the above described pixel drive voltage.

Also, a second aspect of the present invention provides a display unit equipped with a panel in which a plurality of pixels are arranged in a matrix, including: a data receiver for receiving an image frame which corresponds to one screen of image data from outside at preset intervals; a drive for setting luminance for each of the above described plurality of pixels in the above described panel and displaying the above described image on the above described panel; and a mode setting section for setting the above described display unit to one of display modes, including a normal mode which makes the above described display unit create a normal display and a restricted mode, wherein in the above described restricted mode, the above described drive sets an available range of the above described luminance for one part of the above described pixels used to display the above described image frame such that it will be different from an available range of the above described luminance for another part of the above described pixels used to display the above described image frame.

Also, a third aspect of the present invention provides a display unit equipped with a panel in which a plurality of pixels are arranged in a matrix, including: a drive for supplying each of the above described plurality of pixels in the above described panel with a voltage for setting luminance for the pixel; and a mode setting section for setting the above described display unit to one of display modes, including a normal mode which makes the above described display unit create a normal display and a restricted mode, wherein the above described drive periodically reverses polarity of a potential difference applied to the above described pixel by the above described pixel drive voltage, and the above described drive sets the cycle of polarity reversal of the above described potential difference applied to the above described pixel in the above described restricted mode such that it will be longer than that in the above described normal mode.

Also, a fourth aspect of the present invention provides a display unit equipped with a panel in which pixels are arranged in a matrix, including: a mode setting section for setting a display mode of the above described display unit to one of a plurality of the above described display modes; a current supply section for changing a drive current which serves as a reference current for current supplied to the above described panel, according to the above described display mode set by the above described mode setting section; a gate driver for supplying a selection signal to a plurality of the above described pixels arranged in the row direction on the above described panel; and a source driver for supplying each of the above described plurality of pixels selected based on the above described selection signal with a pixel drive current generated according to luminance data which specifies luminance of the given pixel and to the above described drive current.

Also, a fifth aspect of the present invention provides an information processing unit equipped with a panel in which pixels are arranged in a matrix, including: a mode setting section for setting the above described panel to one of display modes, including a normal mode which makes the above described panel create a normal display and a restricted mode which restricts a luminance range of the above described pixels in comparison to the above described normal mode; an instruction section for making the above described panel set the above described display mode to the above described restricted mode upon fulfillment of the necessary condition that there is no user input for a certain period of time; a voltage supply section for supplying a drive voltage which serves as a reference voltage for voltage supplied to the above described panel and restricting a luminance range of the above described pixels in comparison to the above described normal mode when the above described restricted mode is entered; a gate driver for supplying a selection signal to a plurality of the above described pixels arranged in the row direction on the above described panel; and a source driver for supplying each of the above described plurality of pixels selected based on the above described selection signal with a pixel drive voltage generated according to luminance data which specifies luminance of the given pixel and to the above described drive voltage.

Also, a sixth aspect of the present invention provides an information processing unit equipped with a panel in which pixels are arranged in a matrix, including: a mode setting section for setting the above described panel to one of display modes, including a normal mode which makes the above described panel create a normal display and a restricted mode which restricts a luminance range of the above described pixels in comparison to the above described normal mode; an instruction section for making the above described panel set the above described display mode to the above described restricted mode upon fulfillment of the necessary condition that the frequency at which the above described image memory is updated is lower than a preset value; a voltage supply section for supplying a drive voltage which serves as a reference voltage for voltage supplied to the above described panel and restricting a luminance range of the above described pixels in comparison to the above described normal mode when the above described restricted mode is entered; a gate driver for supplying a selection signal to a plurality of the above described pixels arranged in the row direction on the above described panel; and a source driver for supplying each of the above described plurality of pixels selected based on the above described selection signal with a pixel drive voltage generated according to luminance data which specifies luminance of the given pixel and to the above described drive voltage.

Also, a seventh aspect of the present invention provides a display method for controlling a display unit equipped with a panel in which pixels are arranged in a matrix, a voltage supply section for supplying a drive voltage which serves as a reference voltage for voltage supplied to the above described panel, a gate driver for supplying a selection signal to a plurality of the above described pixels arranged in the row direction on the above described panel, and a source driver for supplying each of the above described plurality of pixels selected based on the above described selection signal with a pixel drive voltage generated according to luminance data which specifies luminance of the given pixel and to the above described drive voltage, the above described display method including the steps of: setting the above described display unit to one of a plurality of display modes; and changing the above described drive voltage according to the above described display mode selected.

Also, an eighth aspect of the present invention provides a program for an information processing unit, the above described program controlling a display unit equipped with a panel in which a plurality of pixels are arranged in a matrix, wherein: the above described information processing unit outputs luminance data of a plurality of the above described pixels which form images to the above described display unit and thereby displays the above described images on the above described display unit; and the above described program comprises a mode setting module for making the above described information processing unit set the above described display mode of the above described display unit to either a normal mode in which the above described display unit creates a normal display or a low-power mode which reduces power consumption of the above described display unit compared to the above described normal mode, and set frequency at which the above described information processing unit outputs the above described luminance data in the above described low-power mode such that it will be lower than that in the above described normal mode.

Also, a ninth aspect of the present invention provides a storage medium containing a program for an information processing unit, the above described program controlling a display unit equipped with a panel in which a plurality of pixels are arranged in a matrix, wherein: the above described information processing unit outputs luminance data of a plurality of the above described pixels which form images to the above described display unit and thereby displays the above described images on the above described display unit; and the above described program comprises a mode setting module for making the above described information processing unit set the above described display mode of the above described display unit to either a normal mode in which the above described display unit creates a normal display or a low-power mode which reduces power consumption of the above described display unit compared to the above described normal mode, and set frequency at which the above described information processing unit outputs the above described luminance data in the above described low-power mode such that it will be lower than that in the above described normal mode.

Also, a tenth aspect of the present invention provides a program for controlling a display unit equipped with a panel in which a plurality of pixels are arranged in a matrix, wherein the above described display unit includes: a mode setting module for making the above described display unit set itself to one of display modes, including a normal mode in which the above described display unit creates a normal display and a restricted mode; and an image conversion module for making the above described display unit convert, in the above described restricted mode, an available range of the above described luminance for one part of the above described pixels used to form an image displayed on the above described display unit, such that it will be different from an available range of the above described luminance for another part of the above described pixels used to form the above described image.

Also, an eleventh aspect of the present invention provides a storage medium containing a program for controlling a display unit equipped with a panel in which a plurality of pixels are arranged in a matrix, wherein the above described program includes on the above described display unit: a mode setting module for making the above described display unit set itself to one of display modes, including a normal mode in which the above described display unit creates a normal display and a restricted mode; and an image conversion module for making the above described display unit convert, in the above described restricted mode, an available range of the above described luminance for one part of the above described pixels used to form an image displayed on the above described display unit, such that it will be different from an available range of the above described luminance for another part of the above described pixels used to form the above described image.

BRIEF DESCRIPTION OF THE SEVERAL VIEWS OF THE DRAWINGS

Some of the purposes of the invention having been stated, others will appear as the description proceeds, when taken in connection with the accompanying drawings, in which:

FIG. 6 is a diagram showing display modes set by a mode setting part 240 in a tabular form, according to the embodiment of the present invention;

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of the invention. Accordingly, the description which follows is to be understood as being a broad, teaching disclosure directed to persons of skill in the appropriate arts, and not as limiting upon the present invention.

Figure 1:
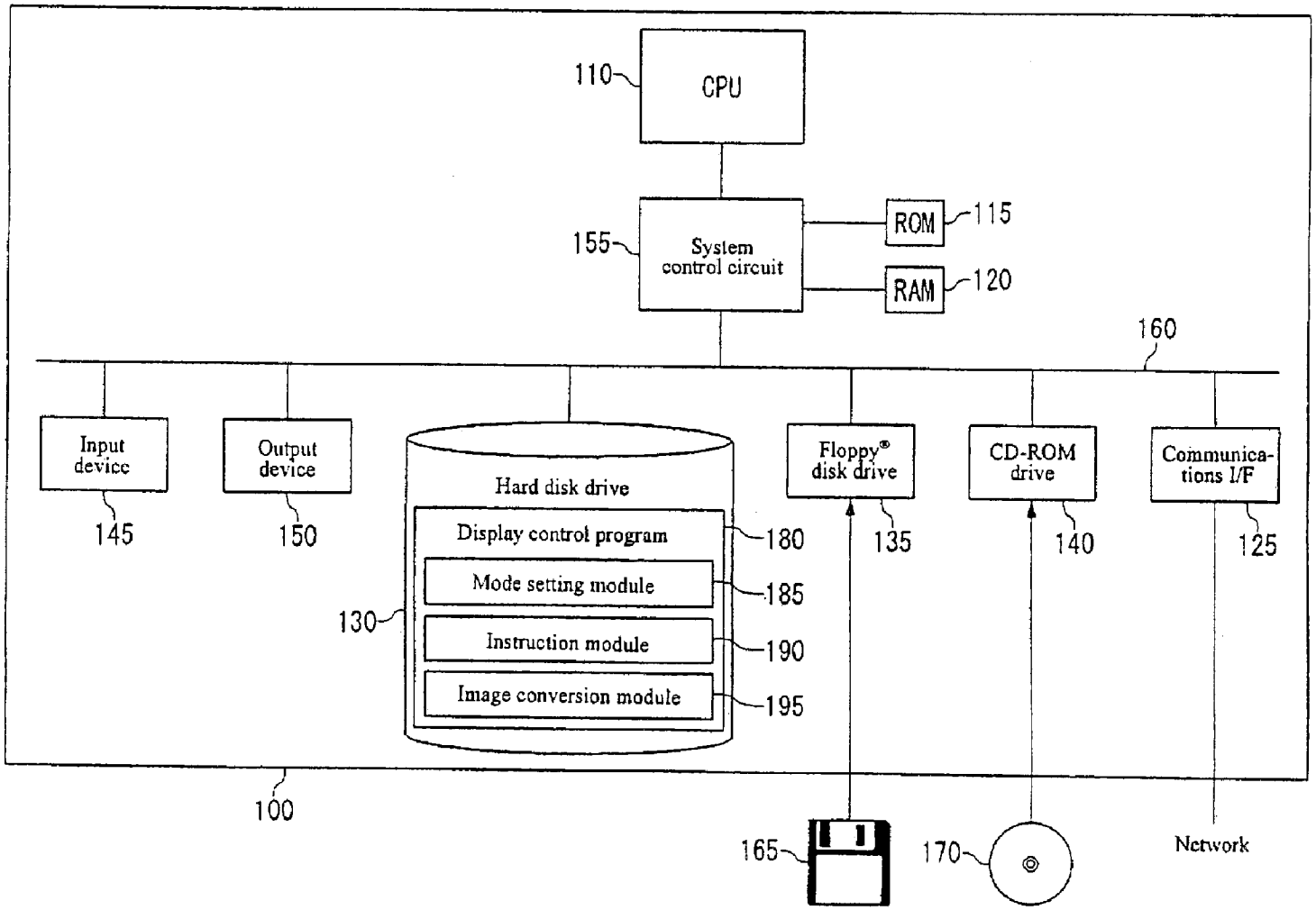
FIG. 1 is a diagram showing a configuration of an information processing unit 100 according to an embodiment of the present invention.

FIG. 1 shows a configuration of an information processing unit 100 according to this embodiment. The information processing unit according to this embodiment 100 comprises a CPU 110, ROM 115, RAM 120, communications interface 125, hard disk drive 130, floppy disk drive 135, CD-ROM drive 140, input device 145, output device 150, system control circuit 155, and input/output bus 160.

The CPU 110 operates based on programs stored on the ROM 115 and RAM 120 and controls various components. The communications interface 125 communicates with other devices via a network. The hard disk drive 130 stores programs and data used by the information processing unit 100 and supplies programs to the RAM 120 based on instructions from the user of the information processing unit 100. The floppy disk drive 135 reads programs or data from a floppy disk 165 and supplies them to the RAM 120. The CD-ROM drive 140 reads programs or data from a CD-ROM 170 and supplies them to the RAM 120. The input device 145 allows the user of the information processing unit 100 to enter instructions. The output device 150 displays images, including characters and/or graphics, for the user, based on instructions from programs operating on the information processing unit 100. The system control circuit 155 connects the CPU 110, ROM 115, RAM 120, communications interface 125, hard disk drive 130, floppy disk drive 135, CD-ROM drive 140, input device 145, and output device 150 with each other. The input/output bus 160 connects the system control circuit 155 with the communications interface 125, hard disk drive 130, floppy disk drive 135, CD-ROM drive 140, input device 145, and output device 150.

The hard disk drive 130 stores a display control program 180 which runs on the CPU 110. The display control program 180 is started by the user or by the operating system which runs on the information processing unit 100. It controls the output device 150. The display control program 180 includes a mode setting module 185, instruction module 190, and image conversion module 195. These modules are programs which make the information processing unit 100 operate as a mode setting section, instruction section, and image conversion section on the information processing unit 100. The mode setting module 185 sets display mode of a display unit in the output device 150 to either a normal mode for normal display or a low-power mode intended to reduce power consumption and extend the life of the display unit. The low-power mode is an example of reduced mode according to the present invention. The instruction module 190 instructs the mode setting module 185 to set the display mode to the low-power mode upon fulfillment of preset conditions. The instruction module 190 may, for example, monitor the input device 145 and make the output device 150 go into the low-power mode upon fulfillment of the necessary condition that there is no user input for a certain period of time. When the display mode of the display unit in the output device 150 is set to the low-power mode, the image conversion module 195 converts, as required, images displayed by the display unit in the output device 150 so that the display unit in the output device 150 can operate at lower power.

The display control program 180 is supplied by the user, being stored on a recording medium such as the floppy disk 165 or CD-ROM 170. The display control program 180 is read from the recording medium, installed in the information processing unit 100 via the floppy disk drive 135 or CD-ROM drive 140, and executed on the information processing unit 100.

The programs or modules described above may be stored on an external storage medium. In addition to the floppy disk 165 and CD-ROM 170, various storage media are available including optical recording media such as a DVD and PD, magneto-optical recording media such as an MO, tape media, and semiconductor memories such as an IC card.

Figure 2:
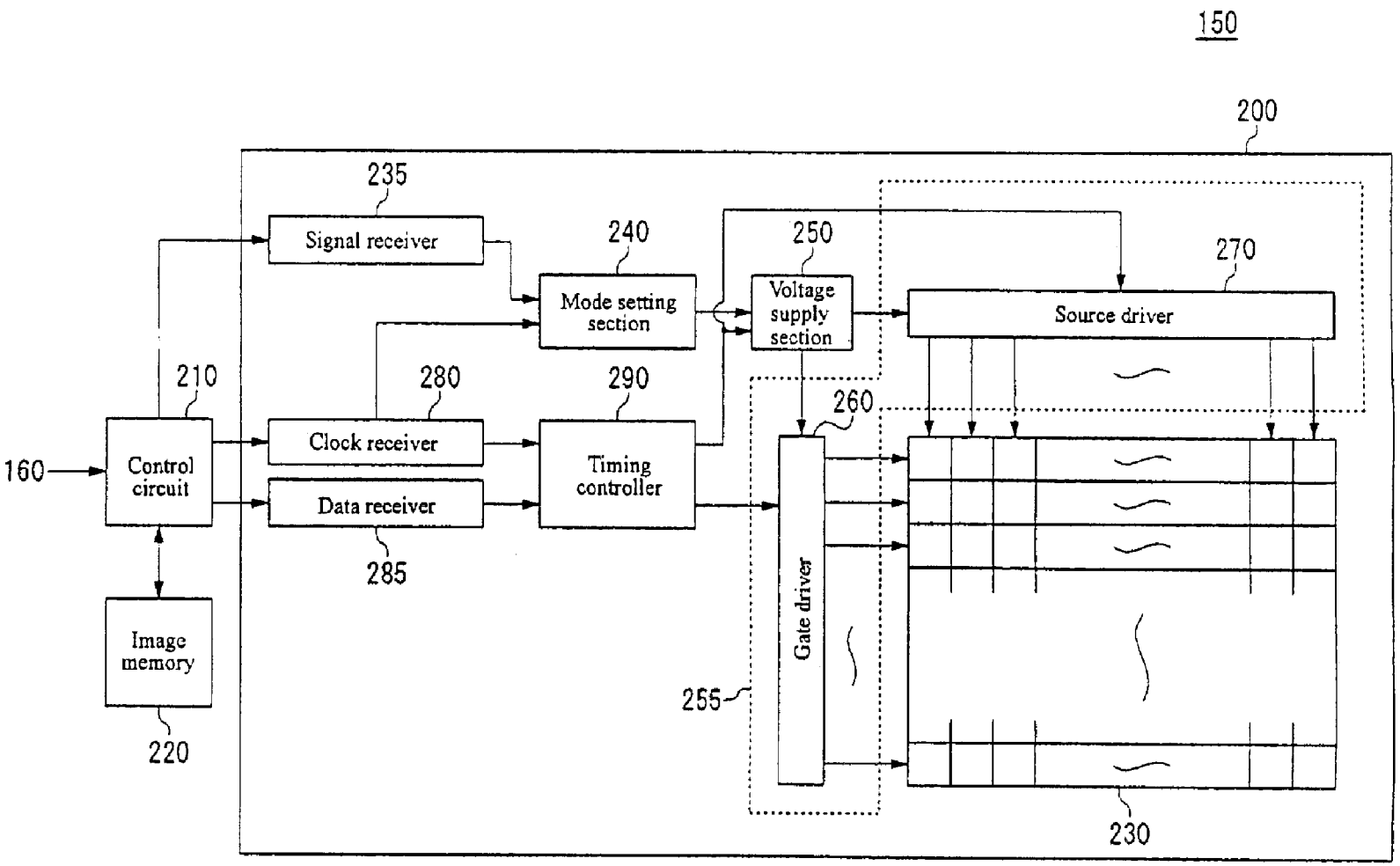
FIG. 2 is a diagram showing a configuration of an output device 150 according to the embodiment of the present invention.

Alternatively, the programs may be supplied to the information processing unit 100 via a dedicated communications network or the Internet using a hard disk, RAM, or other storage device which serves as a recording medium having been installed in a server system connected to the network. FIG. 2 shows a configuration of the output device 150 according to this embodiment. The output device 150 according to this embodiment comprises a display unit 200, control circuit 210, and image memory 220.

The display unit 200 displays images, including characters and/or graphics, for the user, based on instructions from programs operating on the information processing unit 100.

The control circuit 210 controls the display unit 200 as well as the image memory 220 which stores luminance data of each pixel in image data, and thereby carries out an image data storage process, image data output process, and display mode setting process.

In the image data storage process, the control circuit 210 receives data which composes images from the CPU 110 via the system control circuit 155 and stores it in the image memory 220 as image data which includes the luminance of each pixel on screen. In this process, the control circuit 210 may calculate the luminance of each pixel based on information about objects such as rectangles and points which compose the images by receiving it from the CPU 110. Alternatively, the control circuit 210 may directly receive addresses on the image memory 220 and write data from the CPU 110 and store the write data at the appropriate addresses in the image memory 220.

In the image data output process, the control circuit 210 reads the luminance data of each pixel in the image data from the image memory 220 and transmits it in sequence to the display unit 200. When transmitting the luminance data, the control circuit 210 outputs a data transfer clock to the display unit 200 in synchronization with a data signal for outputting the luminance data of each pixel to the display unit 200.

In the display mode setting process, the control circuit 210 sets the display mode of the display unit 200 to either the normal mode or low-power mode based on the setting of the mode setting module 185 which runs on the CPU 110. To set the display mode of the display unit 200 to the low-power mode, the control circuit 210 at least outputs a screen-saving signal instructing the display unit 200 to enter the low-power mode or prolongs the cycle of image data output to the display unit 200. When prolonging the cycle of image data output to the display unit 200, the control circuit 210 lengthens the time required to transmit the luminance data of each pixel to the display unit 200 and lowers the frequency of the data transfer clock.

Next, a configuration of the display unit 200 will be described. The display unit 200 comprises a panel 230, signal receiver 235, data receiver 285, clock receiver 280, timing controller 290, mode setting section 240, voltage supply section 250, and drive 255.

The panel 230 has pixels arranged in a matrix. The panel 230 according to this embodiment is a liquid crystal panel on which the luminance of pixels is set according to potential differences applied to them. It is a normally black type on which pixels are displayed in black when no potential difference is applied to them. The panel 230 may be a liquid crystal panel which employs AFLC technology, MIM elements, TFT-based OCB mode, IPS mode, or MVA mode. Also, the panel 230 may be a display panel other than a liquid crystal panel which sets the luminance of pixels according to potential differences applied to them. Furthermore, the panel 230 may be a normally white type in which pixels are displayed in white when no potential difference is applied to them.

The signal receiver 235 receives a screen-saving signal outputted by the output device 150 in the control circuit 210 upon fulfillment of the necessary condition that there is no user input for a certain period of time. The data receiver 285 receives the luminance data of each pixel in the image data as a data signal from the control circuit 210. The clock receiver 280 receives the data transfer clock inputted in synchronization with the data signal for inputting the luminance data. Based on the data transfer clock received by the clock receiver 280, the timing controller 290 outputs, to the gate driver 260 and source driver 270, timing signals for driving them. Also, the timing controller 290 outputs the luminance data to the source driver 270 in synchronization with the timing signals.

The mode setting section 240 sets the display mode of the display unit 200 to the low-power mode if the signal receiver 235 receives a screen-saving signal and/or if the clock receiver 280 receives a data transfer clock with a lower frequency than that in the normal mode. On the other hand, if the conditions setting for the low-power mode are not satisfied, the mode setting section 240 sets the display mode of the display unit 200 to the normal mode.

The mode setting section 240 sets six display modes for the display unit 200: Modes 1 to 6. Mode 1 is a display mode which makes the display unit 200 create a normal display. Modes 2 to 6 are display modes which make the display unit 200 create a low-power display. Of the low-power modes, Mode 2 is a low drive voltage display mode. In the low drive voltage display mode, the mode setting section 240 makes the voltage supply section 250 supply the source driver 270 with a drive voltage which restricts the luminance range of pixels on the panel 230 in comparison to the normal mode. To set a low-power mode, the mode setting section 240 selects one of the five low-power display mode based on a setting specified by the user of the information processing unit 100 and/or an instruction from the display control program.

The voltage supply section 250 supplies voltage used to operate the drive 255. Also, the voltage supply section 250 changes a reference voltage for the voltage supplied to the panel 230 by the source driver 270 in the drive 255, in accordance with the display mode set by the mode setting section 240.

The drive 255 drives the panel 230 based on image data to display the image data on the panel 230. The drive 255 includes the gate driver 260 and source driver 270. The gate driver 260 supplies a selection signal to a plurality of pixels arranged in the row direction on the panel 230. The source driver 270 supplies each of the pixels selected based on the selection signal from the gate driver 260 with a pixel drive voltage generated according to luminance data which specifies luminance of the given pixel and to the drive voltage from the voltage supply section 250.

Figure 3:
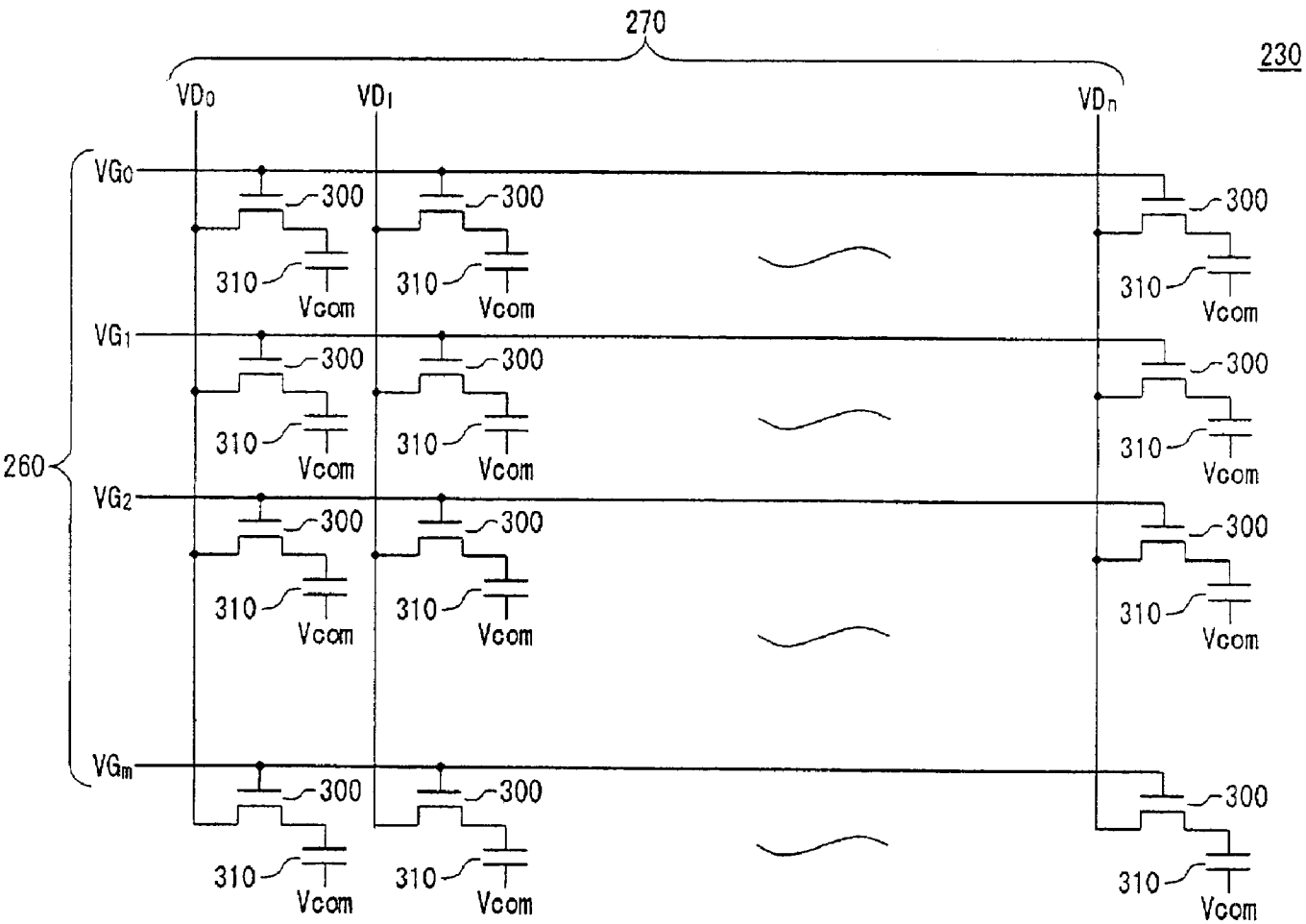
FIG. 3 is a diagram showing a configuration of a panel 230 according to the embodiment of the present invention.

FIG. 3 shows a configuration of the panel 230 according to this embodiment. In the panel 230 according to this embodiment, pixels each of which contains a pixel 310 and corresponding switching element 300 are arranged in the row and column directions.

The switching element 300 switches on when a selection signal VGy (where y=0, 1, . . . , m) from the gate driver 260 is High (H Level). When the switching element 300, switches on, a pixel drive voltage VDx (where x=0, 1, . . . , n) is supplied to the pixel 310 in the corresponding pixel.

The pixel 310 sets its luminance based on the potential difference between the pixel drive voltage VDx and a common voltage Vcom. When the switching element 300 switches off again, the pixel 310 functions also as a capacitor which retains the supplied pixel drive voltage VDx.

The gate driver 260 and source driver 270 display an image frame constituted by one page of image data on the panel 230 as follows. First, the source driver 270 receives one row of luminance data from the control circuit 210. Next, the gate driver 260 sets the selection signal VGy of the pixels arranged in the given row (y-th row) to High. This turns on the switching elements 300 of the pixels arranged in the y-th row. Then, the source driver 270 supplies the appropriate pixel drive voltage VDx (in the case of the x-th column) to each of the pixels selected by the selection signal. Consequently, the pixels 310 in the pixels arranged in the y-th row are supplied with the corresponding VD0 to VDn. Then, the gate driver 260 sets the selection signal VGy of the pixels arranged in the y-th row to Low (L Level). This turns off the switching elements 300 of the pixels arranged in the y-th row. Consequently, the pixels arranged in the y-th row retain VD0 to VDn supplied to them. The above operations allow the gate driver 260 and source driver 270 to set the luminance of the pixels arranged in the y-th row.

Next, the gate driver 260 and source driver 270 set the luminance of the (y+1)th pixel in a manner similar to the one described above. By performing this operation for all the rows on one screen, the display unit 200 can display one screen of image data.

According to this embodiment, it is assumed for the convenience of description that the panel 230 displays each pixel in eight gradations. Also, it is assumed that the luminance data received by the display unit 200 from the control circuit 210 via a data signal is one of integer values 0 to 7. Incidentally, the display unit 200 according to this embodiment may use less than or more than eight gradations for display on the panel 230.

Although the panel 230 is driven in relation to the row and column directions, the rows and columns according to this embodiment may be independent of the up, down, left, and right directions of the image shown to the user. For example, the information processing unit 100 may display images on the panel 230 in such a way that the vertical direction of the images coincide with the column direction of the panel 230 or in such a way that the horizontal direction of the images coincide with the column direction of the panel 230.

Figure 4:
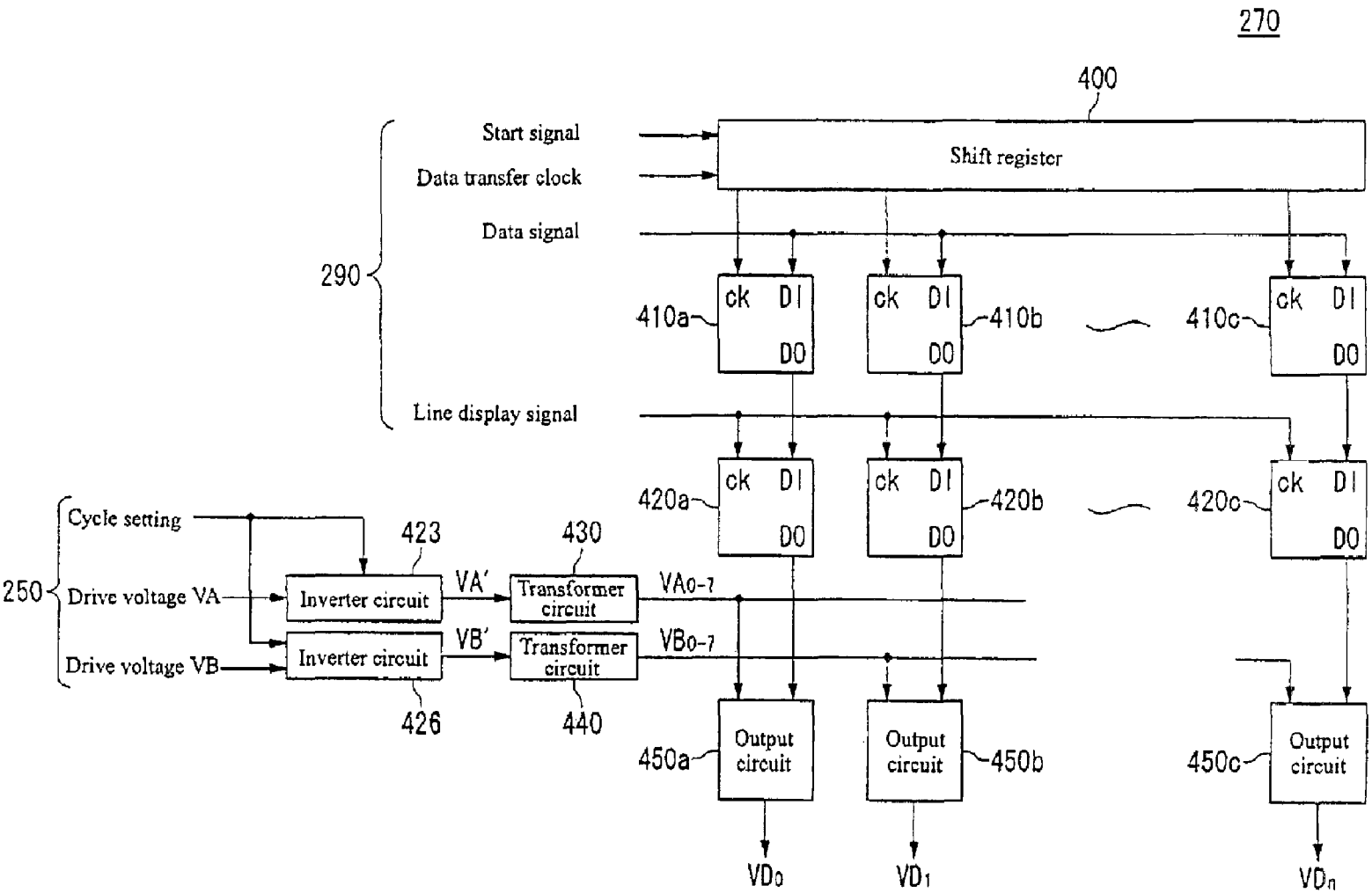
FIG. 4 is a diagram showing a configuration of a source driver 270 according to the embodiment of the present invention.

FIG. 4 shows a configuration of the source driver 270 according to this embodiment.—The source driver 270 according to this embodiment comprises, a shift register 400, sampling memories 410*a* to 410*c*, holding memories 420*a* to 420*c*, an inverter circuit 423, an inverter circuit 426, a transformer circuit 430, a transformer circuit 440, and output circuits 450*a* to 450*c*.

The shift register 400 receives a timing signal which includes a start signal and data transfer clock from the timing controller 290. The start signal specifies, using H Level, when to start sending out luminance data for one row of pixels to the source driver 270. By using these timing signals, the shift register 400 sends out a clock ck to the sampling memory 410*a* while receiving the luminance data for the 0-th row from the data signal, sends out a clock ck to the sampling memory 410*b* while receiving the luminance data for the 1 st row from the data signal, . . . , and sends out a clock ck to the sampling memory 410*c* while receiving the luminance data for the last row from the data signal.

Upon receiving the clock ck from the shift register 400, the sampling memories 410*a* to 410*c* store the luminance data contained in the data signal. Then, the sampling memories 410*a* to 410*c* output the stored luminance data to the corresponding holding memories 420*a* to 420*c*. In this way, upon receiving the luminance data for one row of pixels from the timing controller 290, the sampling memories 410*a* to 410*c* output the luminance data of the pixels at the respective locations.

The holding memories 420*a* to 420*c* store the luminance data outputted by the corresponding sampling memories 410*a* to 410*c* when a line display signal received from the timing controller 290 becomes High level. Then, the holding memories 420*a* to 420*c* output the stored luminance data to the corresponding output circuits 450*a* to 450*c*. When the luminance data for one row of pixels has been transmitted, the timing controller 290 sets the line display signal to High. Consequently, when the source driver 270 receives the luminance data for one row of pixels, the holding memories 420*a* to 420*c* output the luminance data for one row of pixels in synchronization with the line display signal.

To invert the polarity of voltage applied to each pixel in even-numbered rows in the panel 230, the inverter circuit 423 generates an alternating drive voltage VA' by alternately inverting a drive voltage VA with respect to Vcom. Similarly, to invert the polarity of a voltage applied to each pixel in odd-numbered rows in the panel 230, the inverter circuit 426 generates an alternating drive voltage VB' by alternately inverting a drive voltage VB with respect to Vcom. The inverter circuit 423 and inverter circuit 426 set the inversion cycles of VA and VB, respectively, by receiving them from the voltage supply section 250.

The transformer circuit 430 generates pixel drive voltages VA0 to VA7 to be supplied to the panel 230, using the alternating drive voltage VA' received from the inverter circuit 423 as a reference voltage. Here, VA0 to VA7 are pixel drive voltages which correspond to the luminance data values 0 to 7. Similarly, the transformer circuit 440 generates pixel drive voltages VB0 to VB7 to be supplied to the panel 230, using the alternating drive voltage VB' received from the voltage supply section 250 as a reference voltage.

According to the luminance data received from the corresponding holding memories 420*a* to 420*c*, the output circuits 450*a* to 450*c* select the pixel drive voltages VA0 to VA7 or pixel drive voltages VB0 to VB7 and supply them to VD0 to VDn. The output circuits such as 450*a* for the even-numbered rows select respective pixel drive voltages from VA0 to VA7. On the other hand, the output circuits such as 450*b* and 450*c* for the odd-numbered rows select pixel drive voltages from VB0 to VB7.

Figure 5:
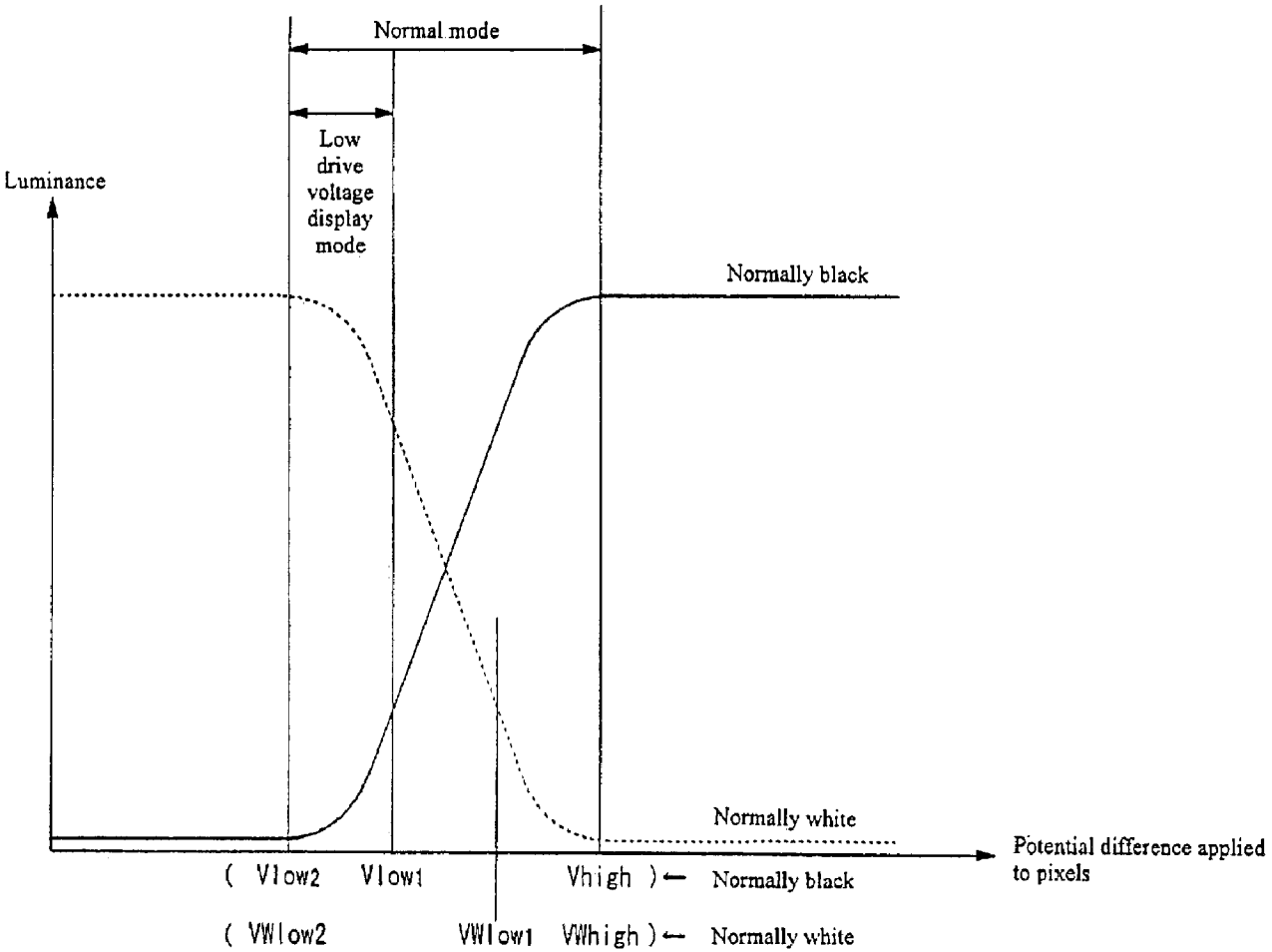
FIG. 5 is a graph of relationship between potential differences applied to pixels 310 and luminance of the pixels 310 according to the embodiment of the present invention.

FIG. 5 shows a graph of the relationship between potential differences applied to the pixels 310 and luminance of the pixels 310 according to this embodiment. In the graph of FIG. 5, the horizontal axis represents the potential difference applied to the pixels 310 and the vertical axis represents the luminance of the pixels 310.

The solid line in FIG. 5 represents the relationship between potential difference and luminance for a normally black type in which pixels are displayed in black when no potential difference is applied to them.

In the case of the normally black type (solid line), pixels are displayed in black when the potential differences applied to them are no higher than Vlow2 and they are displayed in white when the potential differences applied to them are no lower than Vhigh. On the normally black type display unit, the luminance of the pixels is reduced with decreases in the potential differences applied to the pixels by the pixel drive voltages.

In the normal mode which makes the display unit 200 create a normal display, the voltage supply section 250 sets VA and VB to Vhigh. In the normal mode, the source driver 270 outputs pixel drive voltages with a potential difference in the range of Vlow2 to Vhigh to the panel 230.

On the other hand, in the low drive voltage display mode, which reduces power consumption of the display unit 200 compared to the normal mode, the voltage supply section 250 sets VA and/or VB to Vlow1. The source driver 270 outputs pixel drive voltages with a potential difference in the range of Vlow2 to Vlow1 to the panel 230. By setting the drive voltage(s) VA and/or VB to Vlow1, the voltage supply section 250 can set the drive voltage(s) VA and/or VB in the low drive voltage display mode at a level lower than those for the maximum luminance of the pixels in the normal mode. Also, by setting the drive voltage(s) VA and/or VB to Vlow1, the voltage supply section 250 can reduce the range of potential difference applied to the panel 230 and lower the voltage used to drive the panel 230, and thereby reduce the power consumption of the display unit 200 compared to the normal mode.

The broken line in FIG. 5 represents the relationship between potential difference and luminance for a normally white type in which pixels are displayed in white when no potential difference is applied to them.

In the case of the normally white type (broken line), pixels are displayed in black when the potential differences applied to them are VWhigh and they are displayed in white when the potential differences applied to them are VWlow2. On the normally white type display unit, the luminance of the pixels increases with decreases in the pixel drive voltages.

In the normal mode which makes the display unit 200 create a normal display, the voltage supply section 250 sets VA and VB to VWlow2. In the normal mode, the source driver 270 outputs pixel drive voltages with a potential difference in the range of VWhigh to VWlow2 to the panel 230.

On the other hand, in the low-power modes, which reduce power consumption of the display unit 200 compared to the normal mode, the voltage supply section 250 may set VA and/or VB to VWlow1. In this case, the source driver 270 outputs pixel drive voltages with a potential difference in the range of VWhigh to VWlow1 to the panel 230. By setting the drive voltage(s) VA and/or VB to VWlow1, the voltage supply section 250 can set the drive voltage(s) VA and/or VB in the low-power modes at a level lower than those for the maximum luminance of the pixels in the normal mode. Also, by setting the drive voltage(s) VA and/or VB to VWlow1, the voltage supply section 250 can reduce the range of potential difference applied to the panel 230, and in conjunction, for example, with a method for prolonging the inversion cycle of the inverter circuit 423 and/or inverter circuit 426, it can reduce the power consumption of the display unit 200 compared to the normal mode.

FIG. 6 shows the display modes set by the mode setting section 240 according to this embodiment in a tabular form. The mode setting section 240 according to this embodiment has the six display modes—Mode 1 to Mode 6—shown in FIG. 6. Mode 1 is the normal mode while Mode 2 to Mode 6 are low-power modes different from each other. FIG. 6 shows, for each of Mode 1 to Mode 6, transitions of the alternating drive voltages VA' and VB' outputted by the inverter circuit 423 and inverter circuit 426 during each cycle in which the display unit 200 displays one screen.

In the normal mode, the voltage supply section 250 supplies Vhigh to the drive voltages VA and VB. In response, the inverter circuit 423 and inverter circuit 426 sets both VA' and VB' alternately to Vhigh and −Vhigh each time one screen is displayed.

In the low drive voltage display mode, the voltage supply section 250 sets Vlow1 to the drive voltages VA and VB. In response, the inverter circuit 423 and inverter circuit 426 set both VA' and VB' to Vlow1 and −Vlow1 alternately each time one screen is displayed. Thus, in the low drive voltage display mode, the luminance of all the pixels are restricted in comparison to the normal mode, as shown in FIG. 5. Specifically, whereas in the normal mode, the maximum luminance is reached and a white display is created when the potential difference of the pixels is Vhigh, in the low drive voltage display mode, the maximum luminance is reached and a grayish display is created with reduced luminance in comparison to the normal mode when the potential difference of the pixels is Vlow1. On the other hand, even in the low drive voltage display mode, the panel 230 can create displays while maintaining the relationship which exists in the normal mode between values of luminance data and the magnitude of luminance.

In an alternate-row display mode, the pixels in odd-numbered rows are displayed in black in Cycles 1 and 2, and the pixels in even-numbered rows are displayed in black in Cycles 3 and 4. Specifically, in the alternate-row display mode, the voltage supply section 250 sets the drive voltages VA and VB for odd-numbered rows to Vlow2 in Cycles 1 and 2 and sets the drive voltages VA and VB for even-numbered rows to Vlow2 in Cycles 3 and 4. Consequently, in displaying an image frame equivalent to one screen, the drive 255 sets the available range of the luminance for the pixels arranged in the even-numbered rows of the panel 230 such that it will be different from the available range of the luminance for the pixels arranged in the odd-numbered rows of the panel 230. Also, in the alternate-row display mode according to this embodiment, the voltage supply section 250 sets the luminance of the pixels arranged in the even-numbered rows or odd-numbered rows of the panel 230 and used to display the image frame equivalent to one screen to black—a preset luminance.

In an alternate-column display mode, the pixels in odd-numbered columns are displayed in black in Cycles 1 and 2, and the pixels in even-numbered columns are displayed in black in Cycles 3 and 4. Specifically, in the alternate-column display mode, the voltage supply section 250 sets the drive voltage VB to Vlow2 in Cycles 1 and 2 and sets the drive voltage VA to Vlow2 in Cycles 3 and 4. Consequently, in displaying an image frame equivalent to one screen, the drive 255 sets the available range of the luminance for the pixels arranged in the even-numbered columns of the panel 230 such that it will be different from the available range of the luminance for the pixels arranged in the odd-numbered columns of the panel 230. Also, in the alternate-column display mode according to this embodiment, the voltage supply section 250 sets the luminance of the pixels arranged in the even-numbered columns or odd-numbered columns of the panel 230 and used to display the image frame equivalent to one screen to black—a preset luminance.

In a checker display mode, the pixels located at intersections of even-numbered rows and odd-numbered columns or at intersections of odd-numbered rows and even-numbered columns are displayed in black in Cycles 1 and 2, and the pixels located at intersections of even-numbered rows and even-numbered columns or at intersections of odd-numbered rows and odd-numbered columns are displayed in black in Cycles 3 and 4. Specifically, in the checker display mode, the voltage supply section 250 sets the drive voltage VB for even-numbered rows and drive voltage VA for odd-numbered rows to Vlow2 in Cycles 1 and 2 and sets the drive voltage VA for even-numbered rows and drive voltage VB for odd-numbered rows to Vlow2 in Cycles 3 and 4. Consequently, in displaying an image frame equivalent to one screen, the drive 255 sets the available range of the luminance for the pixels located at intersections of even-numbered rows and odd-numbered columns or at intersections of odd-numbered rows and even-numbered columns in the panel 230 such that it will be different from the available range of the luminance for the pixels located at intersections of odd-numbered rows and odd-numbered columns or at intersections of even-numbered rows and even-numbered columns in the panel 230. Also, in the checker display mode according to this embodiment, the voltage supply section 250 sets the luminance of the pixels located at intersections of even-numbered rows and odd-numbered columns and at intersections of odd-numbered rows and even-numbered columns or at intersections of odd-numbered rows and odd-numbered columns and at intersections of even-numbered rows and even-numbered columns in the panel 230 and used to display the image frame equivalent to one screen to black—a preset luminance.

In a changed-inversion-cycle display mode, the voltage supply section 250 changes the cycles of the alternating drive voltages VA' and VB' generated by the inverter circuit 423 and inverter circuit 426 in the source driver 270. Specifically, in the changed-inversion-cycle display mode, the inverter circuit 423 and inverter circuit 426 set the alternating drive voltages VA' and VB' in Cycles 1 and 2 to Vhigh and set the alternating drive voltages VA' and VB' in Cycles 3 and 4 to −Vhigh based on instructions from the voltage supply section 250. Consequently, in the changed-inversion-cycle display mode, the drive 255 can make the polarity inversion cycle of the potential difference applied to pixels twice as long as in the normal mode.

The display unit 200 according to this embodiment may further comprise display modes consisting of combinations of low-power modes described above. For example, it may further comprise a display mode consisting of a combination of the low drive voltage display mode and changed-inversion-cycle display mode.

Figure 7:
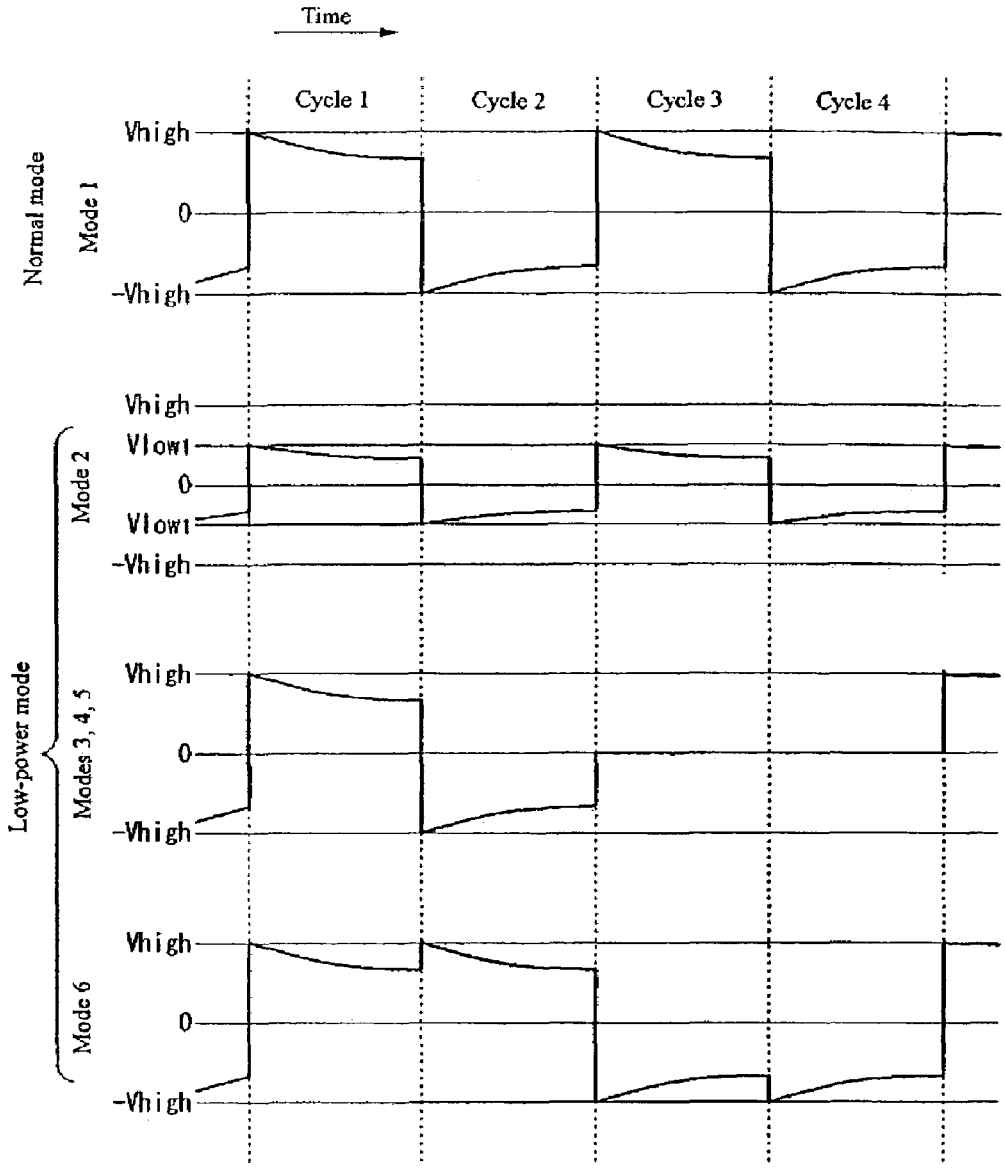
FIG. 7 is a graph showing potential differences applied to the pixels 310 in each display mode according to the embodiment of the present invention.

FIG. 7 is a graph showing the potential differences applied to the pixels 310 according to this embodiment in each display mode. In the figure, the horizontal axis represents time while the vertical axis represents the potential difference of specific pixels 310 in the panel 230.

In the normal mode (Mode 1), the potential difference of specific pixels 310 is set to either Vhigh or −Vhigh in every screen refresh.

In the low drive voltage display mode (Mode 2), the potential difference of specific pixels 310 is set to either Vlow1 or −Vlow1 in every screen refresh. In this way, in the low drive voltage display mode, the voltage supply section 250 can narrow the range of potential difference applied to the pixels 310 in the panel 230 and lower the voltage used to drive the panel 230. Therefore, using the low drive voltage display mode, the display unit 200 can lower its power consumption compared to the normal mode.

Incidentally, the display unit 200 may set Vlow1 to any value between 0 and Vhigh, inclusive, based on an instruction from the user of the information processing unit 100 or from the display control program running on the information processing unit 100. This will allow the user of the information processing unit 100 and the like to make appropriate trade-offs between easy screen viewing and low power consumption.

In the alternate-row display mode (Mode 3), alternate-column display mode (Mode 4), and checker display mode (Mode 5), the potential difference of specific pixels 310 is set to Vhigh in Cycle 1, to −Vhigh in Cycle 2, and 0 (or Vlow2) in Cycles 3 and 4. In this way, in Modes 3 to 5, the voltage supply section 250 can narrow the range of potential difference applied to the pixels in the panel 230 and lower the voltage used to drive the panel 230. Therefore, using any of Modes 3 to 5, the display unit 200 can lower its power consumption compared to the normal mode.

Incidentally, the display unit 200 may set the drive voltage(s) VA and/or VB for part of the pixels, for example, to Vlow1 based on an instruction from the user of the information processing unit 100 or from the display control program running on the information processing unit 100. In that case, Vlow1 may be set to any value between 0 and Vhigh, inclusive. This will allow the user of the information processing unit 100 and the like to make appropriate trade-offs between easy screen viewing and low power consumption.

Also, the display unit 200 may be configured such that it can set the number of the rows to be displayed in black to ¾, ½, ¼ of the total rows based on an instruction from the user of the information processing unit 100 or from the display control program running on the information processing unit 100.

In the changed-inversion-cycle display mode (Mode 6), the potential difference of specific pixels 310 is set to Vhigh in Cycles 1 and 2, and to −Vhigh in Cycles 3 and 4. In the changed-inversion-cycle display mode, the drive 255 can make the polarity inversion cycle of the potential difference applied to pixels half as long as in the normal mode. Therefore, the display unit 200 can lower its power consumption compared to the normal mode.

Also, the display unit 200 may be configured such that it can vary the polarity inversion cycle of the potential difference applied to pixels based on an instruction from the user of the information processing unit 100 or from the display control program running on the information processing unit 100.

Figure 8:
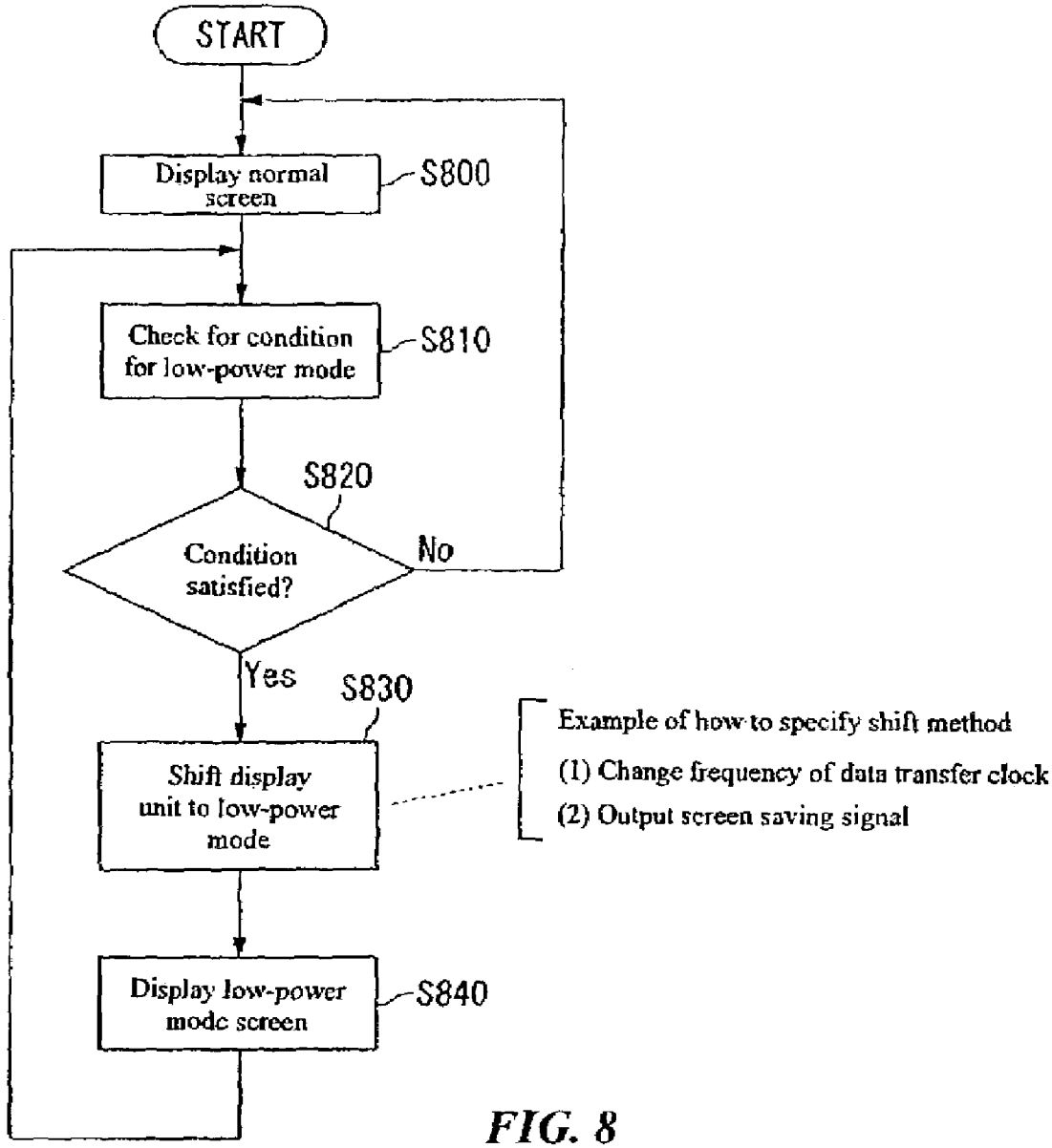
FIG. 8 is a diagram showing a process flow of a display control program 180 running on the information processing unit 100 according to the embodiment of the present invention.

FIG. 8 shows a process flow of the display control program 180 running on the information processing unit 100.

First, the instruction module 190 running on the information processing unit 100 sets the display mode of the display unit 200 to the normal mode (S800). If the display unit 200 is in a low-power display mode, the instruction module 190 instructs the mode setting module 185 to set the display mode to the normal mode. Based on the instruction from the instruction module 190, the mode setting module 185 sets the display mode to the normal mode. Specifically, the mode setting module 185 instructs the control circuit 210 to set the display mode of the display unit 200 to the normal mode. The control circuit 210 makes the display unit 200 set the normal mode either by informing the display unit 200 that no screen saving will be made at a screen-saving signal or by making the cycle of image data output to the display unit 200 shorter than that in the normal mode.

Next, the instruction module 190 running on the information processing unit 100 detects whether a condition for setting the display unit 200 to a low-power mode is satisfied (S810). If no input is entered in the information processing unit 100 from the user of the information processing unit 100 for a certain period of time or if the frequency at which the image memory 220 is updated by the CPU 110 in the information processing unit 100 or the like is lower than a preset value, the instruction module 190 determines that the condition for setting the display unit 200 to a low-power mode is satisfied.

If the condition for setting the display unit 200 to a low-power mode is not satisfied, the instruction module 190 goes to S800 and proceeds with screen display in the normal mode (S820).

If the condition for setting the display unit 200 to a low-power mode is satisfied, the instruction module 190 instructs the mode setting module 185 to set the display mode to the low-power mode (S830). Based on the instruction from the instruction module 190, the mode setting module 185 sets the display mode to the low-power mode. Specifically, the mode setting module 185 instructs the control circuit 210 to set the display mode of the display unit 200 to the low-power mode. The control circuit 210 makes the display unit 200 set the low-power mode either by informing the display unit 200 that screen saving will be made at a screen-saving signal or by making the cycle of image data output to the display unit 200 longer than that in the normal mode.

Next, the image conversion module 195 converts the images displayed by the display unit 200, as required, so that the display unit 200 can operate at lower power (S840). For example, if the display unit 200 is not provided with the alternate-row display mode (Mode 3), alternate-column display mode (Mode 4), or checker display mode (Mode 5), the image conversion module 195 converts the image data in the image memory 220 so that the images stored in the image memory 220 will be approximately the same as the images displayed on the panel 230 in these modes. In other words, the image conversion module 195 changes the available range of the luminance for one part of the pixels forming the images displayed on the display unit 200 such that it will be different from the available range of the luminance for another part of the pixels forming the images. After the process in S840, the display control program 180 goes to S810.

Figure 9:
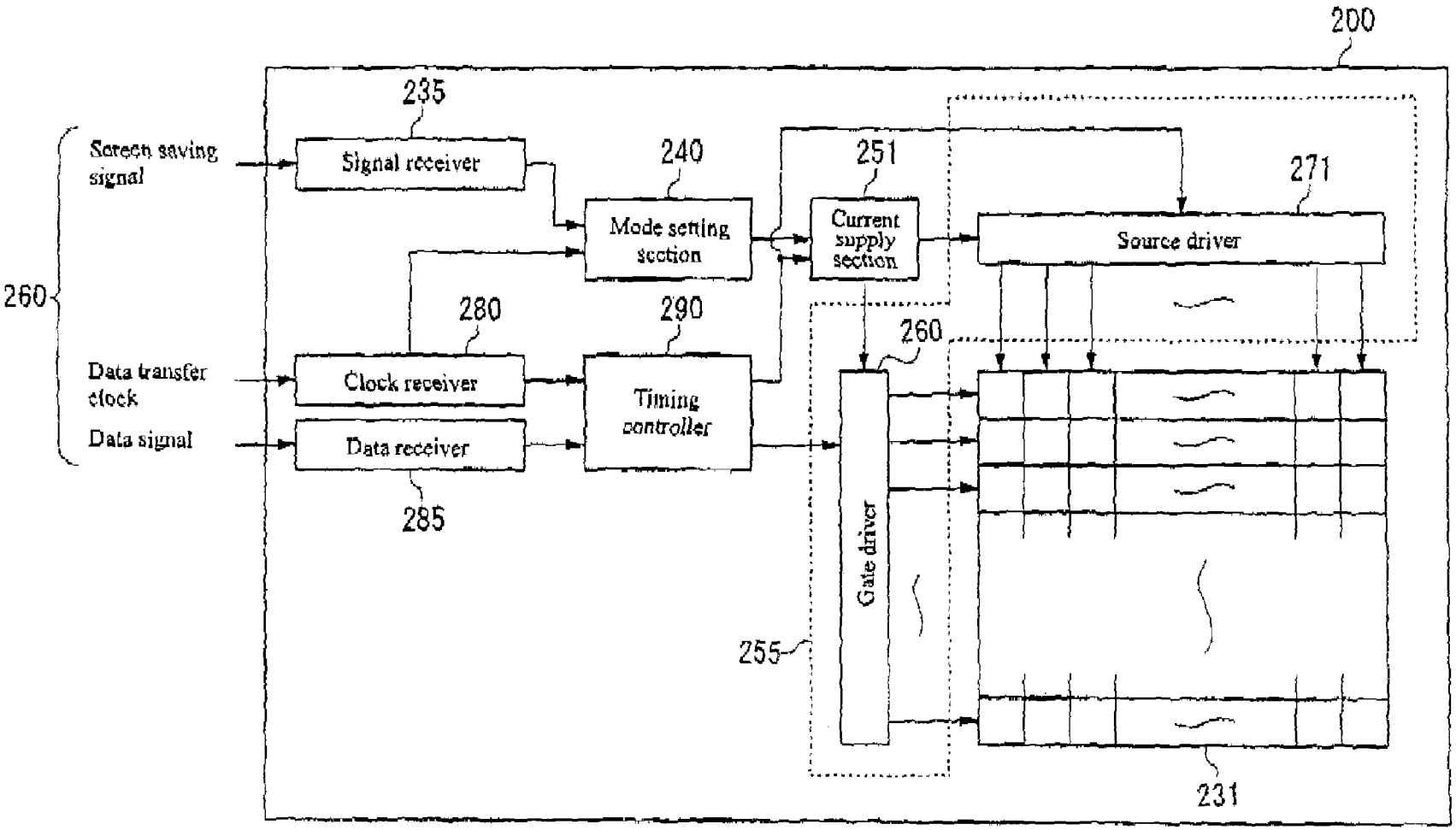
FIG. 9 is a diagram showing a configuration of a display unit 200 according to a variation of the embodiment of the present invention.

FIG. 9 shows a configuration of the display unit 200 according to a variation of this embodiment. The display unit 200 according to the variation of this embodiment comprises a panel 231, signal receiver 235, data receiver 285, clock receiver 280, timing controller 290, mode setting section 240, current supply section 251, and drive 255 which in turn includes a gate driver 260 and source driver 271. The signal receiver 235, data receiver 285, clock receiver 280, timing controller 290, mode setting section 240, and gate driver 260 according to the variation of this embodiment are approximately the same as the corresponding components of the display unit 200 according to this embodiment shown in FIG. 2, and thus description thereof will be omitted.

The panel 231 has pixels arranged in a matrix The panel 231 according to the variation of this embodiment sets the luminance of pixels according to the current applied to them. Here, description will be given mainly of a normally black panel in which pixels are displayed in black when no current is applied to them. The panel 231 may be an organic EL or inorganic EL panel in which the luminance of pixels is set according to the current applied to them.

The current supply section 251 supplies a current used to operate the drive 255. Also, the current supply section 251 changes a reference current for the current supplied to the panel 231 by the source driver 271 in the drive 255, in accordance with the display mode set by the mode setting section 240.

The drive 255 drives the panel 231 based on image data to display the image data on the panel 231. The drive 255 includes the gate driver 260 and source driver 271. The gate driver 260 supplies a selection signal to a plurality of pixels arranged in the row direction on the panel 231. The source driver 271 supplies each of the pixels selected based on the selection signal from the gate driver 260 with a pixel drive current generated according to luminance data which specifies luminance of the given pixel and to the drive current from the current supply section 251.

As described above, the display unit 200 of this embodiment can vary the drive voltage supplied to the source driver 270, according to the display mode of the display unit 200. This makes it possible to implement low-power modes for reducing the power consumption of the display unit 200 compared to the normal mode and/or extending the life of the display unit 200. Also, the display unit 200 allows the drive voltage which is supplied to the source driver 270 to be set to a value according to user preferences. This allows the user to specify a low-power mode of the display unit 200 appropriately by making appropriate trade-offs between easy screen viewing and low power consumption.

The information processing unit 100 and display unit 200 according to this embodiment allow the display mode of the display unit 200 to be specified according to the frequency of the data transfer clock. Consequently, the information processing unit 100 can slow the refresh rate, reduce the power consumption, and extend the life of the display unit 200 even if the display unit 200 is not provided with a low-power mode which corresponds to the frequency of the data transfer clock. Also, the display unit 200 can accept an instruction of specification of a display mode via the same one as an interface provided on a typical display or other display unit.

Furthermore, the information processing unit 100 and/or display unit 200 according to this embodiment can set the display unit 200 to a low-power mode which restricts the luminance range of pixels in comparison to the normal mode if there is no input from the user of the information processing unit 100 for a certain period of time. This makes it possible to set the display unit 200 to a low-power mode while the user of the information processing unit 100 is not operating the information processing unit 100, and thus to reduce the power consumption and extend the life of the display unit 200.

Furthermore, the information processing unit 100 and/or display unit 200 according to this embodiment can set the display unit 200 to a low-power mode which restricts the luminance range of pixels in comparison to the normal mode if the frequency at which the image memory 220 is updated in the information processing unit 100 or the like is lower than a preset value. This makes it possible to set the display unit 200 to a low-power mode while the user of the information processing unit 100 is not operating the information processing unit 100, and thus to reduce the power consumption and extend the life of the display unit 200.

Furthermore, the information processing unit 100 and/or display unit 200 according to this embodiment can set an available range of the luminance for one part of pixels used to form images displayed on the display unit in a low-power mode, such that it will be different from an available range of the luminance for another part of the pixels used to form the images. This makes it possible to lower the voltage used for driving one part of the pixels in the panel 230, and thus to reduce the power consumption and extend the life of the display unit 200.

Furthermore, the display unit 200 according to this embodiment can make the polarity inversion cycle of the potential difference which is applied to the pixels in the panel 230 in a low-power mode longer than that in the normal mode. This makes it possible to prolong the cycle of voltage fluctuations in the pixels in the panel 230, and thus to reduce the power consumption and extend the life of the display unit 200.

Furthermore, the display unit 200 according to the variation of this embodiment can vary the drive current supplied to the source driver 271, according to the display mode of the display unit 200. This makes it possible to implement low-power modes for reducing the power consumption of the display unit 200 compared to the normal mode and/or extending the life of the display unit 200. Also, the display unit 200 allows the drive current which is supplied to the source driver 271 to be set to a value according to user preferences. This allows the user to specify a low-power mode of the display unit 200 appropriately by making appropriate trade-offs between easy screen viewing and low power consumption.

In the drawings and specifications there has been set forth a preferred embodiment of the invention and, although specific terms are used, the description thus given uses terminology in a generic and descriptive sense only and not for purposes of limitation. For example, instead of the display unit 200 according to this embodiment, it is also possible to use a computer or terminal which further comprises all or part of the CPU 110, ROM 115, RAM 120, communications interface 125, hard disk drive 130, floppy disk drive 135, CD-ROM drive 140, input device 145, and the output device 150 in the information processing unit 100.

What is claimed is:

1. Apparatus comprising:

a display unit equipped with a panel in which pixels are arranged in a matrix;

a mode setting section for setting said display unit to one of a plurality of display modes;

a voltage supply section for changing a drive voltage which serves as a reference voltage for voltage supplied to said panel, according to said display mode set by said mode setting section;

a gate driver for supplying a selection signal to a plurality of said pixels arranged in the row direction on said panel;

a source driver for supplying each of said plurality of pixels selected based on said selection signal with a pixel drive voltage generated according to luminance data which specifies luminance of the given pixel and to said drive voltage; and a clock receiver for receiving a data transfer clock inputted in synchronization with a data signal for supplying said display unit with luminance data of a plurality of said pixels, wherein said mode setting section:

sets said display unit to one of said display modes, including a normal mode which makes said display unit create a normal display and a restricted mode which makes said voltage supply section supply said drive voltage in such a way as to restrict a luminance range of said pixels in comparison to said normal mode, and sets said display mode to said restricted mode upon fulfillment of the necessary condition that frequency of said data transfer clock is lower than that in said normal mode.

2. Apparatus according to claim 1, wherein said display unit is a normally black display unit in which the luminance of a pixel decreases with decreases in a potential difference applied to said pixel by said pixel drive voltage.

3. Apparatus according to claim 1, wherein said restricted mode is a low-power mode which reduces power consumption of said display unit compared to said normal mode.

4. Apparatus according to claim 1 further comprising a signal receiver for receiving a screen-saving signal outputted upon fulfillment of the necessary condition that an information processing unit which a generates screen displayed on said display device does not receive user input for a certain period of time, wherein said mode setting section:

sets said display unit to either a normal mode which makes said display unit create a normal display or a restricted mode which makes said voltage supply section supply said drive voltage in such a way as to restrict a luminance range of said pixels in comparison to said normal mode, and sets said display mode to said restricted mode if said screen-saving signal is received.

5. Apparatus according to claim 4, wherein said restricted mode is a low-power mode which reduces power consumption of said display unit compared to said normal mode.

6. Apparatus according to claim 1, wherein:

said mode setting section sets said display unit to one of said display modes, including a normal mode which makes said display unit create a normal display and a low-power mode which reduces power consumption of said display unit compared to said normal mode, and said voltage supply section sets said drive voltage for said low-power mode such that the maximum luminance of said pixels in said low-power mode will be lower than the maximum luminance of said pixels in said normal mode.

7. A display unit equipped with a panel in which a plurality of pixels are arranged in a matrix, comprising:

a data receiver for receiving an image frame which corresponds to one screen of image data from outside at preset intervals;

a drive for setting luminance for each of said plurality of pixels in said panel and displaying said image on said panel;

a mode setting section for setting said display unit to one of display modes, including a normal mode which makes said display unit create a normal display and a restricted mode, wherein in said restricted mode, said drive sets an available range of said luminance for one part of said pixels used to display said image frame such that it will be different from an available range of said luminance for another part of said pixels used to display said image frame; and wherein said drive selects a plurality of said pixels arranged in the row direction on said panel, sets luminance for each of a plurality of said selected pixels, and thereby displays said image frame on said panel, and in said restricted mode, said drive sets an available range of said luminance for a plurality of said pixels arranged in the first row on said panel and used to display said image frame such that it will be different from an available range of said luminance for a plurality of said pixels arranged in the second row on said panel and used to display said image frame.

8. The display unit according to claim 7, wherein:

said drive selects a plurality of said pixels arranged in the column direction on said panel, sets luminance for each of a plurality of said selected pixels, and thereby displays said image frame on said panel, and in said restricted mode, said drive sets an available range of said luminance for a plurality of said pixels arranged in the first column on said panel and used to display said image frame such that it will be different from an available range of said luminance for a plurality of said pixels arranged in the second column on said panel and used to display said image frame.

9. The display unit according to claim 7, wherein in said restricted mode, said drive sets said luminance for part of said pixels used to display said image frame to a preset value.

* * * * *